US006858323B1

(12) United States Patent
Giering et al.

(10) Patent No.: US 6,858,323 B1
(45) Date of Patent: Feb. 22, 2005

(54) VALUABLE DOCUMENT

(75) Inventors: Thomas Giering, Kirchseeon (DE); Rainer Hoppe, Nürnberg (DE); Thomas Attenberger, Poing (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 09/926,579

(22) PCT Filed: May 23, 2000

(86) PCT No.: PCT/EP00/04694

§ 371 (c)(1),
(2), (4) Date: Feb. 26, 2002

(87) PCT Pub. No.: WO00/71363

PCT Pub. Date: Nov. 30, 2000

(30) Foreign Application Priority Data

May 25, 1999 (DE) ..... 199 23 959

(51) Int. Cl.[7] ..... G01N 21/00

(52) U.S. Cl. ..... 428/690; 283/92; 356/71; 427/162; 427/212; 427/215; 427/220; 428/206; 428/207; 428/403

(58) Field of Search ..... 283/92; 356/71; 427/162, 212, 215, 220; 428/206, 207, 211, 323, 403, 690

(56) References Cited

U.S. PATENT DOCUMENTS

| | | | | |
|---|---|---|---|---|
| 4,452,843 A | * | 6/1984 | Kaule et al. | 428/199 |
| 5,100,587 A | | 3/1992 | Clough et al. | |
| 6,165,592 A | * | 12/2000 | Berger et al. | 428/195 |

FOREIGN PATENT DOCUMENTS

| | | | | |
|---|---|---|---|---|
| DE | 41 26 461 A1 | * | 2/1993 | 428/690 |
| DE | 197 08 543 A1 | | 9/1998 | |
| EP | 0 522 627 A1 | | 1/1993 | |
| WO | 97/10307 | | 3/1997 | |

* cited by examiner

*Primary Examiner*—Bruce H. Hess
(74) *Attorney, Agent, or Firm*—Bacon & Thomas, PLLC

(57) ABSTRACT

The invention relates to a document of value, such as a paper of value, ID card or the like, having at least one authenticity feature in the form of a luminescent substance. The luminescent substance has particles consisting of a dye-laden molecular sieve whose structure forms an optical resonator. In said resonator at least one dye can be excited to show stimulated emission, the dye being incorporated in the cavities of the molecular sieve or located in or on the internal and external surfaces of the molecular sieve, and the transition to stimulated emission being accompanied by a detectable change in the luminescent properties of the dye.

20 Claims, 3 Drawing Sheets

VALUABLE DOCUMENT

Figure 1:
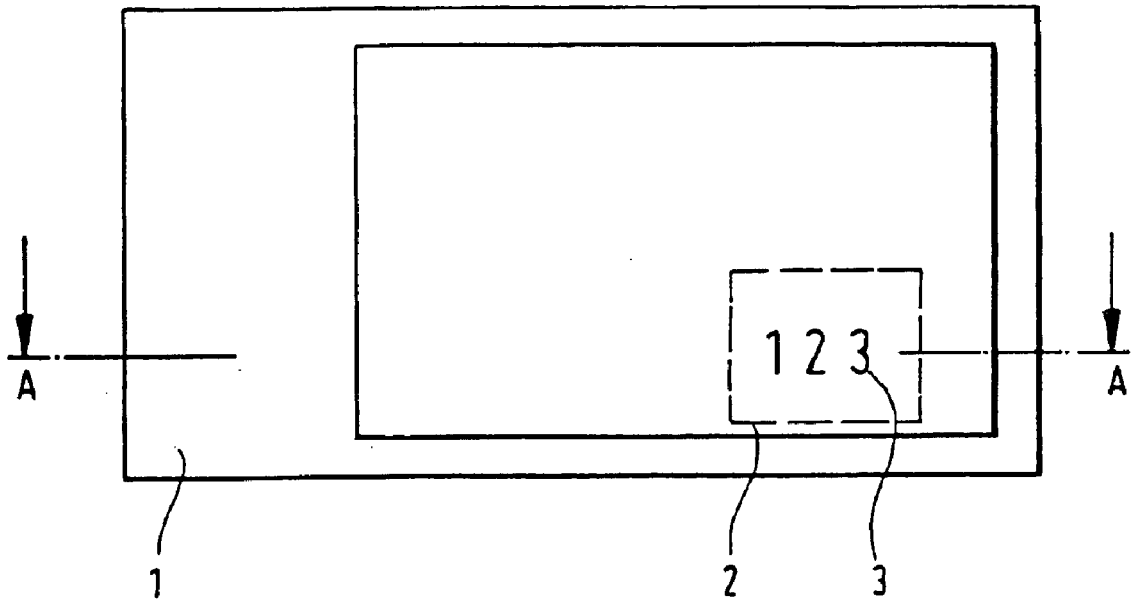

This invention relates to a document of value, such as a paper of value, ID card or the like, having at least one authenticity feature in the form of a luminescent substance. The invention further relates to a security element having at least one authenticity feature in the form of a luminescent substance and to a method for marking products whereby the product is provided with a luminescent substance. Luminescent substances have been used for some time for marking products in particular for security applications. The advantage of such a marking is that upon suitable illumination of the marked object the luminescent substances emit with high intensity and are thus detectable while areas without the luminescent substances appear substantially dark. In this way the markings can be detected with high sensitivity. Numerous luminescent materials used for marking in the past have very broad emission bands. This is typical in particular of organic dyes, whose luminescence line widths can be several 50 nanometers and more. Many classic inorganic luminescent materials have similar line widths.

EP 0 522 627 A1 describes the production of molecular sieves capable of luminescence and their use as a fluorescent substance for lamps. The reactants (complexing agent and rare earth ions) are incorporated by diffusion in solution into the cavities of zeolites where they react exhaustively into chelate complexes. The chelate complex is fixed in the interior of the cavities.

In addition, colored molecular sieves containing metal salts as the chromophoric component have been known for some time under the name "ultramarine dyes/pigments" (German patent no. 1, 1877). These purely inorganic systems are produced for example by heating zeolite molecular sieves with alkali metal sulfides in a nonoxidizing atmosphere and then in an oxidizing atmosphere at temperatures over 300° C. (JP-A-63-017 217; JP-A-55-071 762).

Organic dyes are applied to the molecular sieves normally by treating colorless molecular sieves with dye solutions (see e.g. JP-A-63-017 217; JP-A-53-022 094 and JP-A-75-008 462). In particular in the case of neutral dyes adsorbed only weakly on the molecular sieve framework, there is a danger of the dyes being washed off the molecular sieve upon the addition of solvents. An improvement of adhesion is obtained with strongly basic dyes.

It is known to use pigments comprising an inorganic substrate (often laminated minerals, zeolites or zeolite-like materials) and an adsorbed coloring agent in lacquers and water-based paints (JP-PS-75-008 452). When using said pigments it is necessary to select the composition of the paint in such a way that the coloring pigment does not react with the surrounding medium, is insoluble in the solvent used, and deposits uniformly, which is important in particular with mixed colors. This excludes many solvents and binders that are interesting for paint production and greatly restricts the possibilities of mixed color production using the described pigments.

The stated disadvantages are avoided by an irreversible fixation of dyes in the cavities of suitable molecular sieves. DE 41 26 461 describes the production of such materials and their use as pigments and optical data memories. Dyes such as phthalocyanines, phenoxazines, azo dyes, etc., are fixed irreversibly by forming the molecular sieve in-situ around the dye. This technique is generally called "crystallization inclusion" (G. Schulz-Ekloff, "Nonlinear optical effects of dye-loaded molecular sieves," in Advanced Zeolite Science and Application Studies in Surface Sciences Catalysis, Vol. 85 (1994), 145–175). Another method for irreversible fixation of dyes in molecular sieves, "ship-in-the-bottle synthesis," has been described e.g. by G. Meyer et al. (Zeolites 4 (1984), 30). Transition metal-exchanged zeolites are reacted here with o-phthalonitrile, whereby the dye (cobalt, nickel or copper phthalocyanine) is formed in the supercages of approximately 12 angstroms in the faujasite. Since said supercages are only accessible through openings of approximately 7 angstroms to 8 angstroms, the phthalonitrile can diffuse into the cavities but the formed dye cannot diffuse out for steric reasons.

On the basis of said so-called "ship-in-the-bottle" synthesis technique, WO 93/17965, DE 42 07 339 A1 and DE 41 31 447 A1 describe the production of colorants based on molecular sieves. Indigoid dyes, azo dyes and quinizarin dyes are incorporated into molecular sieves from the classes of zeolites and zeolite-like materials.

The described systems and intended uses have in common that the luminescent materials retain their characteristic properties which they also possess in solutions or as powders. By incorporation in the zeolites only slight shifts and broadenings of the spectral bands are observed, in particular with organic dyes. For application as a marking, these effects are not advantageous. Since the emission bands of numerous different luminescent materials overlap, the selectivity of detection of the substances is greatly restricted. Although chemically different materials are present, the differences in their emission bands are often so small that their luminescence must be examined over a broad spectral region with elaborate means to make identification at all possible. For many applications the effort for clear identification is therefore so great that it can be done only in exceptional cases.

The invention is therefore based on the problem of providing a document of value and a security element for marking any products with at least one luminescent material which is easily detected and identified.

This problem is solved by the features of the independent claims. Developments are the subject matter of subclaims.

According to the present invention, the authenticity feature used for documents of value is a luminescent system wherein the line width of dyes is greatly reduced by the effect of stimulated emission in order to permit differentiation of as great a number as possible of characteristic narrow-band luminescence lines of different dyematrix systems in a selected spectral region. The stimulated emission processes are caused by the dyes being located in a resonator enclosing the dyes. The resonator is formed by a molecular sieve crystallite whose surfaces enclose the luminescence of the dye molecules. The luminescence radiation is coupled out via microdefects in said surfaces.

Said systems are dye-laden molecular sieves which show stimulated emission. They were presented for the first time at the Tenth German Zeolite Conference. These were AlPO-5 type molecular sieves loaded with pyridine-2. The effect was likewise observed on an AlPO-5 molecular sieve that was doped with rhodamine and produced by means of "crystallization inclusion."

According to the invention, however, any other dye-laden molecular sieves which show stimulated emission can also be used. The dyes used may be not only representatives from the classes of pyridines and rhodamines but also dyes from the class of cyanines or coumarins or any other dyes from the class of laser dyes. The spectral properties of the dyes may be adjusted by suitable chemical modification of the chromophore. A plurality of different dyes may also be provided in one molecular sieve.

The molecular sieve used is preferably a molecular sieve with a channel structure and suitable morphology, such as from the classes AFI, LTL, MFI, M4IS. Specifically one may use for example AlPO-5, SAPO-5 (AFI class) as well as MAPO and MAPSO, ELAPO and ELAPSO. M stands here for any metal such as Mn, Mg, Co, Fe, Cr, Zn, and EL for an element such as Li Be, B, Ti, As, Ga, Ge.

In order to increase the light resistance of the material, a UV absorber and/or a UV stabilizer on the basis of sterically hindered amines (HALS) can be embedded, preferably in a dosage of from 0.5 to 3 wt. %, in the cavities of the molecular sieve in addition to the dye. In this way a photostabilization is additionally obtained outside the UV region, in particular at the wavelength of the dye. The UV absorber used can be for example Tinuvin-P, Tinuvin 928 (Ciba Geigy). The sterically hindered amines are for example Tinuvin 144 (Ciba Geigy), Tinuvin 123 (Ciba Geigy), HALS 3051 (Clariant) or derivatives thereof.

Said materials increasing light resistance need not necessarily be incorporated into the cavities of the molecular sieve; they may also be located in or on the internal and external surfaces of the molecular sieve.

If chemical stability is to be increased besides light resistance, antioxidants can also be incorporated into the cavities instead of or in addition to the UV stabilizers or UV absorber.

The invention is based on the finding that said systems are very advantageously suited for marking applications since an intraparticle resonator is used for greatly reducing the luminescence line width of the system upon suitable excitation. This permits differentiation of a large number of different dyes via the spectral positions of their luminescence spectra. That is, said dyes can be used to represent a plurality of codings. The number of different markings can be increased even further by additionally evaluating the intensity of the emitted radiation, which is proportional to the quantity of luminescent material or dye present.

The inventive idea can thus be used to form a great variety of coding systems. For example, an object can be marked with different ones of the above-described dyes. The coding then arises through the presence or absence of one or more particles.

However, coding systems are also possible involving variation of both number and structure (selection of dye-molecular sieve combination). Weak excitation thus gives rise to an opaque mixed spectrum that is difficult to separate spectrally. Only strong excitation causes the above-described particles to reveal their special property and stand out from the broad-band luminescence spectrum of the mixture.

The characteristic properties of the dye-molecular sieve systems show themselves only upon intensive optical excitation with light of a suitable wavelength. Due to the threshold behavior of the systems, the optical irradiance must exceed a threshold value characteristic of the systems. Typical threshold values are 0.2 to 4 megawatts per square centimeter. The excitation source may be a light source of suitable wavelength with sufficient radiation capacity. An optical apparatus can be used to focus the light of the excitation source on a sufficiently small spot and thus increase the irradiance of the systems.

In the following some examples of the dyes or authenticity features to be used according to the invention will be stated.

EXAMPLE 1

Dyes from the class of pyridines are enclosed in a suitable molecular sieve such as a SAPO-5 molecular sieve. Upon excitation with a frequency-doubled Nd:YAG laser the dye-laden molecular sieve absorbs in the region of the laser wavelength of 532 nanometers. At a laser power density of 4 megawatts per square centimeter the dye-laden molecular sieve shows a very narrow-band laser-like fluorescence spectrum in the region of approximately 680 nanometers.

EXAMPLE 2

A dye from the class of rhodamines is enclosed in a suitable molecular sieve belonging e.g. to the structure type MFI, LTL, EMT, MIS, AFI, CHA. Upon excitation with a frequency-doubled Nd:YAG laser and at a laser power density of 4 megawatts per square centimeter this material shows a very narrow-band laser-like fluorescence spectrum in the region of 560 nanometers.

EXAMPLE 3

A dye from the class of coumarins is enclosed in a suitable molecular sieve such as an AlPO-5 molecular sieve. Upon excitation with an XeCl excimer laser with a wavelength of 308 nanometers and a laser power density of 4 megawatts per square centimeter the molecular sieve shows a very narrow-band laser-like fluorescence spectrum in the region of 530 nanometers.

Detection of the systems must involve the detection of at least one of the following characteristic properties of the systems to permit a delimitation over conventional luminescent materials without stimulated emission.

The characteristic increase in intensity in a narrow wave range upon supraliminal excitation can be detected upon observation through the characteristic threshold behavior of the increase in intensity when irradiance is increased by means of a suitable spectrally narrowing element in the detection channel.

Characteristic luminescence line narrowing can be detected by comparison of the intensifies in the narrow wave range characteristic of the dye system with the intensity in other wave ranges. This is done e.g. by means of a spectrometer setup with sufficient spectral resolution or by measurement in different detection channels which measure the intensity in the required spectral region through suitable spectrally selective elements. Upon supraliminal excitation a characteristic spectral distribution is observed with an intensity peak at the characteristic wavelength or characteristic intensity relations in the different channels which do not occur with conventional luminescent dyes.

The characteristic shortening of the lifetime of luminescence at the characteristic wavelength of the dye system to typically under 300 picoseconds likewise permits differentiation of the systems from conventional luminescent dyes (typical lifetime over 3 nanoseconds). This requires excitation sources whose turn-off times are clearly shorter than the lifetime of conventional luminescent dyes. The decay times of detector and detection electronics must also be comparably fast.

As a further characteristic property of the systems, the saturation of the optical transition occurs only at very much higher luminescence intensities, so that much higher luminescence intensities can be observed with these systems than with conventional luminescent materials.

Upon suitable synthesis the described molecular sieves form microcrystals or crystal-like structures, to be referred to as particles in the following. The particles can be used directly for marking any objects, in particular papers of value, passports, forms, CDs or other products of daily use. The simplest possibility is to add the particles to a printing ink. The particles can also be added directly to the material of the object, however. This is expedient for example if the object to be protected is a document of value such as a bank note or ID card. In the case of the bank note, the particles are preferably added to the paper pulp during production of the bank note paper. With ID cards, however, one of the cover or inlay layers can be mixed with the particles in its volume. The particles can likewise be embedded directly in a polymer.

According to another embodiment, the inventive authenticity feature or dyeladen molecular sieves can also be combined with a kind of camouflage material. In this case two luminescent materials are used for producing a marking, one of the materials being a conventional luminescent material and the other an inventive dyeladen molecular sieve. Upon subliminal excitation both materials behave the same way, while upon supraliminal excitation the emission behavior of the dye-laden molecular sieve changes, as explained above. If for example a bar code is printed with the inventive particles and the spaces in the bar code with conventional luminescent material, subliminal excitation permits detection of only a uniformly luminescent field. Supraliminal excitation of the inventive particles results in narrow luminescence peaks in the emission spectrum in the area of the bars of the code, thereby making the code visible. This principle can of course also be used to represent any other codings or information.

The materials, conventional luminescent material and inventive molecular sieve, may also be contained jointly in a printing ink or another carrier material. In this case, supraliminal excitation of the molecular sieve serves as an additional authenticity feature and thus increases forgery-proofness.

Further examples and advantages of the invention will be explained with reference to the figures. It is pointed out that these are merely schematic diagrams which raise no claim to completeness or true-to-scale representation.

Figure 2:
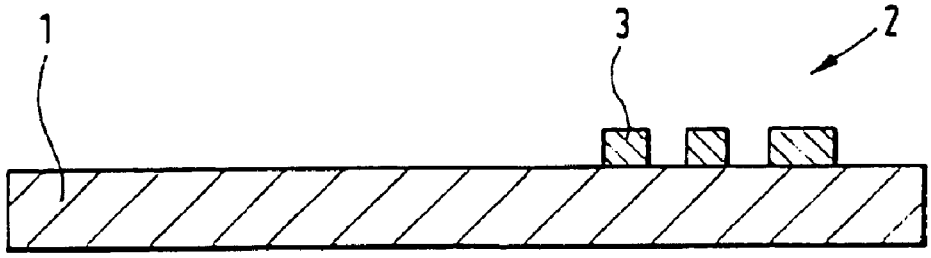
Figure 3:
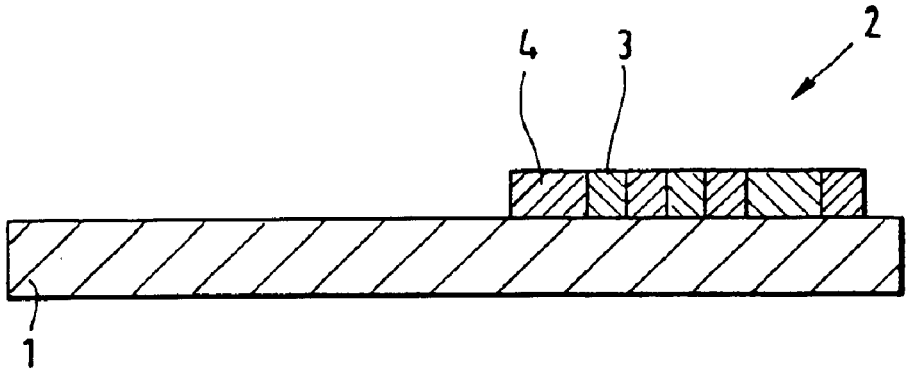
Figure 4:
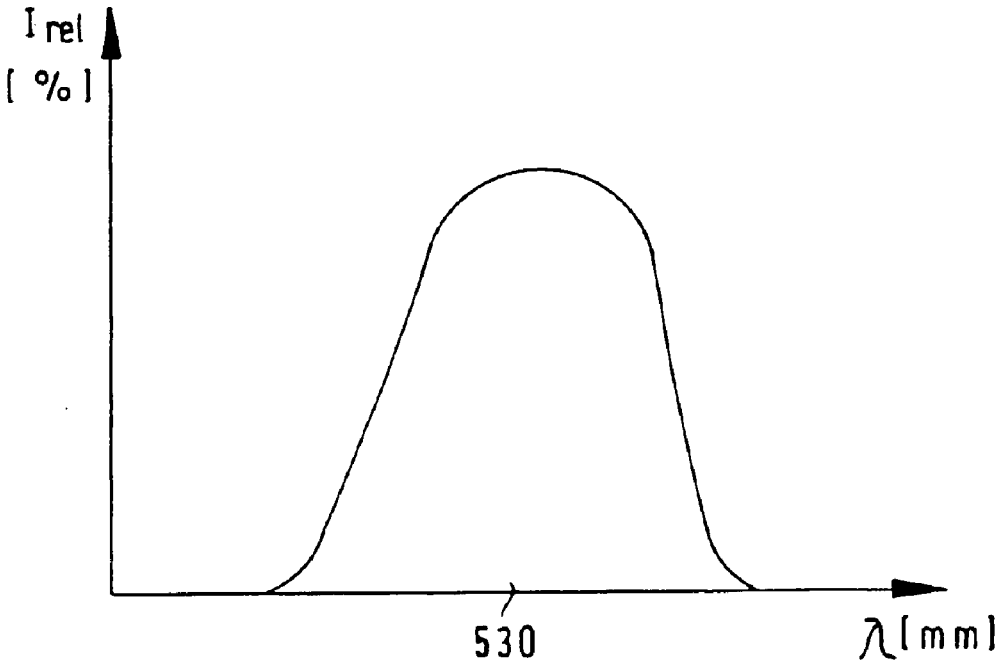
Figure 5:
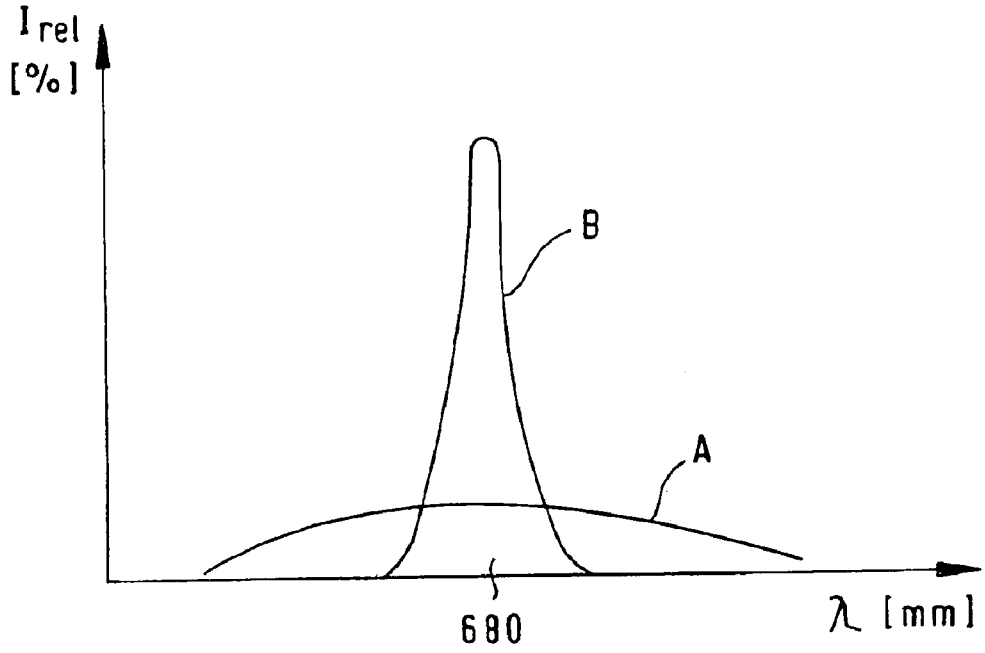
Figure 6:
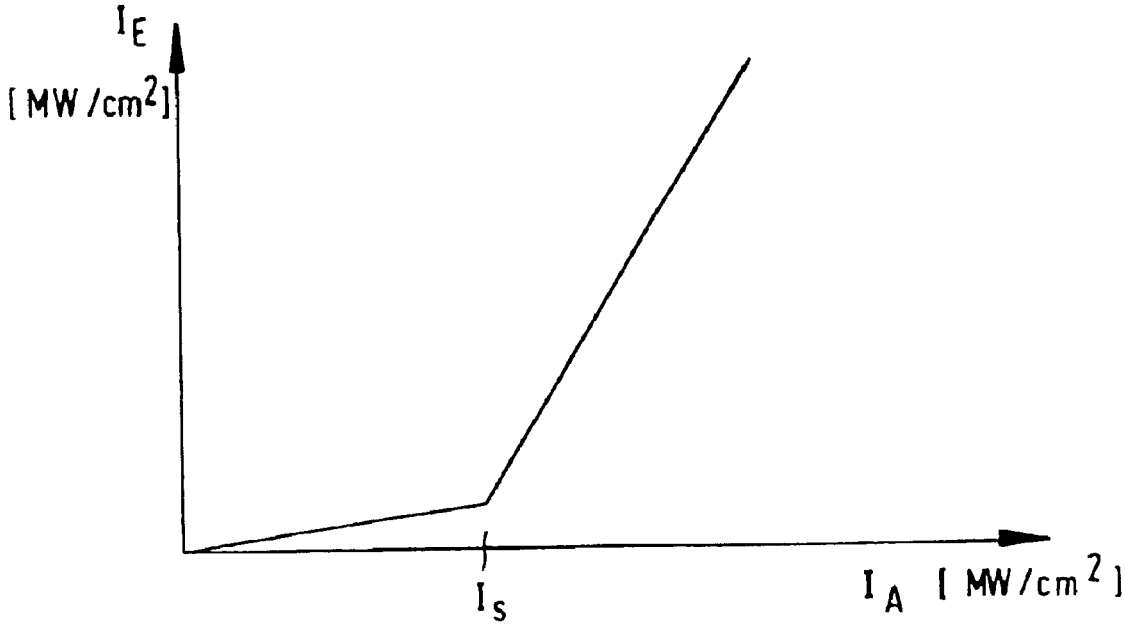

FIG. 1 shows an inventive document of value with an inventive authenticity feature, FIG. 2 shows a section along A—A of the document of value in FIG. 1, FIG. 3 shows a section along A—A of another embodiment of the inventive document of value, FIG. 4 shows an absorption spectrum of an inventive authenticity feature, FIG. 5 shows an emission spectrum of an inventive authenticity feature, FIG. 6 shows the behavior of the emission intensity as a function of the excitation intensity of an inventive authenticity feature.

FIG. 1 shows inventive document of value 1 with inventive security element 2. In the shown example, security element 2 consists of an area shown by the dash line in which the actual authenticity feature, print 3, is disposed. Print 3 contains the inventive dye-laden molecular sieve particles.

Alternatively, security element 2 could also be designed in the form of a label bearing authenticity feature 3 in the form of a print. It is likewise possible to design security element 2 in the form of a thread or band, authenticity feature 3 being disposed on a carrier material, preferably a plastic foil. Said band can be either disposed all over the surface of document of value 1 or embedded at least partially into the document of value. This manner of incorporation is expedient in particular with bank notes, which are frequently provided with so-called "window security threads."The security thread is woven here quasi into the paper during its production so that it passes directly to the surface of the paper in certain areas.

FIG. 2 shows the document of value shown in FIG. 1 along line A—A in cross section. Print 3 on document of value 1, which forms the authenticity feature in the present case, contains particles which are formed by a dye-laden molecular sieve. Authenticity feature 3 is usually invisible in normal illumination, becoming recognizable only after excitation with corresponding radiation. Depending on the desired effect, authenticity feature 3 or the print forming authenticity feature 3 can also contain further dyes that are actually visible visually. It must be ensured, however, that said additional dyes have no appreciable absorption in the emission wave range of the inventive particles.

FIG. 3 shows another embodiment of inventive document of value 1 in cross section along line A—A. Here security feature 2 does not consist only of authenticity feature 3 in the form of a print but additionally has camouflage print 4 surrounding authenticity feature 3 in the total area of security element 2. That is, the area shown by the dash line in FIG. 1 is provided completely with camouflage print 4 except for the area of authenticity feature 3. Camouflage print 4 contains a usual luminescent material, which is likewise transparent preferably in the visible spectral region. Additionally, said luminescent material shows the same absorption and emission behavior as the inventive particles as long as it is excited with a laser power density below the threshold value characteristic of said particles. In this way a corresponding detector can perceive security element 2 only as a uniformly luminescent surface upon subliminal excitation. Upon supraliminal excitation the emission behavior of authenticity feature 3 changes and the marking shown by authenticity feature 3 stands out in the form of narrow, very high-intensity emission lines from the luminescent background formed by camouflage print 4.

FIG. 4 shows the absorption spectrum of an inventive dye-laden molecular sieve in the region of 530 nanometers.

If a light source with low radiation density is used for irradiating authenticity feature 3, the authenticity feature shows relatively broad-band luminescence emission which is based on spontaneous emission and shown in FIG. 5 by curve A. However, if the radiation density of the excitation light source is above a certain threshold value, the dyes enclosed in the molecular sieve show stimulated emission. Here the material shows very narrow-band emission in the region of 680 nanometers, as shown by curve B in FIG. 5.

FIG. 6 illustrates this state of affairs. Emission intensity of $I_E$ grows only slowly with the excitation intensity below threshold $I_S$. Above threshold value $I_S$ the stimulated emission of the dye-laden molecular sieve sets in so that the emission intensity grows very much faster with the excitation intensity. Here, the molecular sieve surrounding the dye acts like a laser resonator which intensifies the luminescent radiation emitted by the dye like a laser.

According to the invention a plurality of particles consisting of different dyeladen molecular sieves can also be mixed together. Subliminal excitation thus gives rise to a practically unresolvable emission spectrum since the relatively broad emission bands of the individual luminescent dyes greatly overlap. Only supraliminal excitation causes the emission lines of the individual dyes to narrow very greatly and show the above-described laser-like behavior. In this state the individual spectral lines of the dyes can be distinguished very well from each other.

What is claimed is:

1. A document of value for example a paper of value, ID card or the like, comprising at least one authenticity feature in the form of a luminescent substance, the luminescent substance having particles comprising a dye-laden molecular sieve whose structure forms an optical resonator in which at least one dye can be excited to show stimulated emission, the dye being incorporated in the cavities of the molecular sieve or located in or on the internal and external surfaces of the molecular sieve and wherein the transition to stimulated emission is accompanied by a detectable change in the luminescent properties of the dye.

2. The document of value according to claim 1, wherein the luminescent substance comprises different particles comprising different dye-laden molecular sieves.

3. The document of value according to claim 2, wherein the molecular sieve includes a channel structure, such as classes of aluminophosphates.

4. The document of value according to claim 1, wherein the dye molecules comprise a class of laser dyes.

5. The document of value according to claim 1, wherein the spectral properties of the dye have been adjusted by selection of the end groups.

6. The document of value according to claim 1, wherein the molecular sieve includes different excitable dyes.

7. The document of value according to claim 1, wherein the document of value has a further authenticity feature.

8. The according to claim 7, wherein the second authenticity feature comprises a further luminescent material which preferably has the same body color as the luminescent substance.

9. The document of value according to claim 1, wherein the luminescent substance is present in the volume of the document of value.

10. The document of value according to claim 1, wherein the luminescent substance is admixed to a printing ink.

11. The document of value according to claim 10, wherein the printing ink is applied in the form of a coding, for example a bar code.

12. The document of value according to claim 10, wherein the printing ink with the luminescent substance is surrounded by a second printing ink with a further luminescent substance.

13. The document of value according to claim 10, wherein the printing ink is applied at least in certain areas to the document of value or to a carrier connected with the document of value.

14. The document of value according to claim 1, wherein the luminescent substance is disposed in or on a security element connected with the document of value.

15. A security element having comprising at least one authenticity feature in the form of a luminescent substance, the luminescent substance having particles comprising a dye-laden molecular sieve whose structure forms an optical resonator in which at least one dye can be excited to show stimulated emission, the dye being incorporated in the cavities of the molecular sieve or located in or on the internal and external surfaces of the molecular sieve, and wherein the transition to stimulated emission is accompanied by a detectable change in the luminescent properties of the dye.

16. The security element according to claim 15, wherein the security element includes at least one carrier material in the volume or on the surface of which the luminescent substance is disposed.

17. The security element according to claim 15, wherein the security element has the form selected from the group consisting of a strip, band and a label.

18. A method for marking a product comprising:

providing a product with a luminescent substance having particles comprising a dye-laden molecular sieve whose structure forms an optical resonator in which at least one dye can be excited to show stimulated emission;

incorporating the dye in the cavities of the molecular sieve or located in or on the internal and external surfaces of the molecular sieve, and selecting the dye such that the transition to stimulated emission is accompanied by a detectable change in the luminescent properties of the dye.

19. A method for checking a luminescent substance having particles comprising a dye-laden molecular sieve whose structure forms an optical resonator, comprising the steps:

selecting at least one dye that can be excited to show stimulated emission;

incorporating the dye in the cavities of the molecular sieve or located in or on the internal and external surfaces of the molecular sieve;

selecting the dye such that the transition to stimulated emission is accompanied by a detectable change in the luminescent properties of the dye; and using the line narrowing and line shift and/or the threshold behavior and/or the shortening of the lifetime as an authenticity feature.

20. A process for marking products comprising using dye-laden molecular sieves showing stimulated luminescence without an external resonator for marking the products.

* * * * *